United States Patent [19]

Johnson

[11] 4,153,137

[45] May 8, 1979

[54] BOAT LADDER

[76] Inventor: Edward H. Johnson, 3050 NE. 48 St., #101, Ft. Lauderdale, Fla. 33308

[21] Appl. No.: 944,174

[22] Filed: Sep. 20, 1978

[51] Int. Cl.[2] ..... B63B 27/14; B63B 29/20; E06C 5/40

[52] U.S. Cl. ..... 182/97; 182/108; 182/129; 182/179; 9/1.6

[58] Field of Search ..... 182/97, 107, 108, 129, 182/179; 9/1.6

[56] References Cited

U.S. PATENT DOCUMENTS

| | | | |
|---|---|---|---|
| 1,025,474 | 5/1912 | Magoon | 182/108 |
| 1,450,694 | 4/1923 | Mahoney | 182/107 |
| 2,310,062 | 2/1943 | Broncato | 182/108 |
| 3,052,896 | 9/1962 | Beach | 9/1.6 |
| 3,169,503 | 2/1965 | Lane | 9/1.6 |
| 3,305,045 | 2/1967 | Schlecht | 182/97 |
| 3,774,720 | 11/1973 | Hovey | 182/97 |
| 3,869,742 | 3/1975 | Gale | 9/1.6 |

*Primary Examiner*—Reinaldo P. Machado
*Attorney, Agent, or Firm*—Allen D. Gutchess, Jr.

[57] ABSTRACT

A Boat Ladder is provided which can be in the form of a complete ladder or a kit for mounting a ladder on a boat. The ladder preferably includes two or more ladder sections which can be readily connected and disassembled and easily stowed. Two mounting brackets are designed for use on a variety of gunwhales of boats. The lower section of the ladder has two threaded mounting pins which are adjustably held in the brackets to level the ladder and the pins can be easily separated from the mounting brackets when the ladder is not in use. The mounting pins are also pivoted so as to be swung out of the way along the rails of the ladder, when not in use.

10 Claims, 4 Drawing Figures

BOAT LADDER

This invention relates to boarding ladders and ladder kits for boats.

This invention is disclosed in Disclosure Documents 067009 and 061554.

Boat owners in many areas must encounter a wide range of water levels due to tides and also due to changes in wind velocity and direction. Smaller boats, in such instances, those under about 30 feet in length, for example, have gunwhales which are usually below the height of the dock or docks which are used by the boat owners. Consequently, the boats are frequently boarded and disembarked by ladders permanently mounted on the docks. When the boat owner visits another dock, there may be no ladder at all or he may have to wait while others are using the ladder. The lower ends of the ladders are in the water at least part of the time, in most instances, and are weakened or eaten away by the water over a period of time, particularly when used in salt water. The ladders also are disposed in vertical positions and are dangerous and difficult to climb, particularly by older boat owners. Also, the wake of another boat or waves can cause the boat being boarded or disembarked to rise and fall and possibly cause injury to persons on the ladder who are caught between the boat and the ladder. Further, such ladders are commonly climbed from the bow of the boat and it is frequently difficult and dangerous to reach the bow from the cockpit or other area toward the stern of the boat. This usually requires tight-rope walking along the narrow gunwhales of the boat to reach the bow.

The present invention provides a ladder assembly for boats which is designed to be always carried with the boat and overcomes the disadvantages discussed above. The ladder assembly preferably includes a ladder made in two or more sections, when two or more sections are needed, so as to be easily stowed in an out-of-the-way position in the boat. For example, where six-foot tides are encountered, two three-foot ladder sections are preferably employed and are usually sufficient. The lower ends of the ladder base section have two pivotal mounting pins in the rails. These pins are inserted into openings in two mounting brackets which are mounted on the gunwhale of the boat in spaced positions corresponding to the spacing of the mounting pins of the lower ladder section. The gunwhales of boats frequently slope downwardly toward the stern and, of course, will slope at varying degrees, depending on the design of the boat. To accommodate varying slopes, mounting pins have adjustable stop collars thereon which limit the extent to which the pins extend into the mounting brackets. Consequently, the collars can be adjsted to position the ladder upright even though the gunwhale slopes. Preferably, the mounting pins are threaded and the stop collars are turned thereon to the desired position and rest on the tops of the brackets when the pins are inserted into the bracket openings. The pins have right-angled upper ends which are pivotally mounted in blocks affixed to the ladder rails so that the pins can be swung up along the rails, out of the way, when not in use.

When an upper ladder section is used, it has connecting bars extending downwardly from the lower ends of the rails which are received in the upper ends of the rails of the lower ladder section. Suitable catches can be employed between the upper and the lower ladder section rails to hold them securely together.

Preferably, the boat owner will employ two sets of the mounting brackets, one on each side of the boat in the same longitudinal positions on the gunwhales. Also, rungs of the ladder are preferably round. With this arrangement, then, the boat owner can readily transfer the ladder across from one set of brackets to the other without changing the adjustment of the mounting pins for boarding and disembarking on either side.

The ladder assembly can be sold as a complete unit with the lower ladder section, pivot blocks, and mounting pins assembled as a unit and sold with one or two pair of brackets. However, if desired, the pivot blocks, mounting pins, and mounting brackets can be sold as a kit with the boat owner supplying his own ladder.

The boat assembly according to the invention is always accessible to the boat owner, avoiding a situation where there is no ladder at all or where he must wait to use one. The ladder is always out of the water, regardless of the water level. Further, the upper portion of the ladder, when mounted in the brackets, rests against the edge of the dock and is at an angle, making it easier to climb than a vertical ladder. Even though the angle will vary somewhat depending upon the water level relative to the height of the dock, this is not a significant problem.

It is, therefore, a principal object of the invention to provide a boat ladder assembly having the features and advantages discussed above.

Many other objects and advantages of the invention will be apparent from the following detailed description of a preferred embodiment thereof, reference being made to the accompanying drawings, in which.

Figure 1:
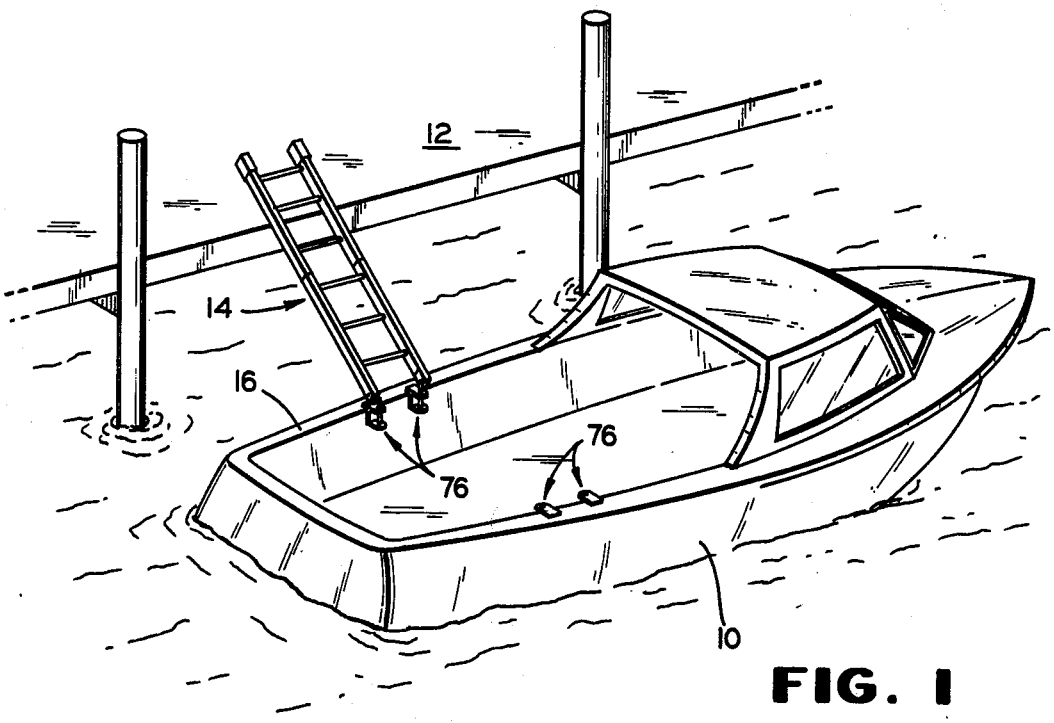
FIG. 1 is a somewhat schematic view in perspective of a boat, dock, and boat ladder embodying the invention.

Referring to FIG. 1, a boat 10 is shown alongside a dock 12 with a boat ladder 14 embodying the invention in position against the edge of the dock for boarding the boat or disembarking from it. With the ladder mounted on a gunwhale 16 of the boat, it is never in the water as is substantially always true of a ladder mounted permanently on a dock. Further, the boat owner or passenger on the ladder will never be caught between the ladder and the side of the boat and subject to injury if the boat should suddenly rise and fall due to the wake of another boat or rough waves. The ladder is always at an angle so as to be more easily climbed than a vertical ladder.

Figure 2:
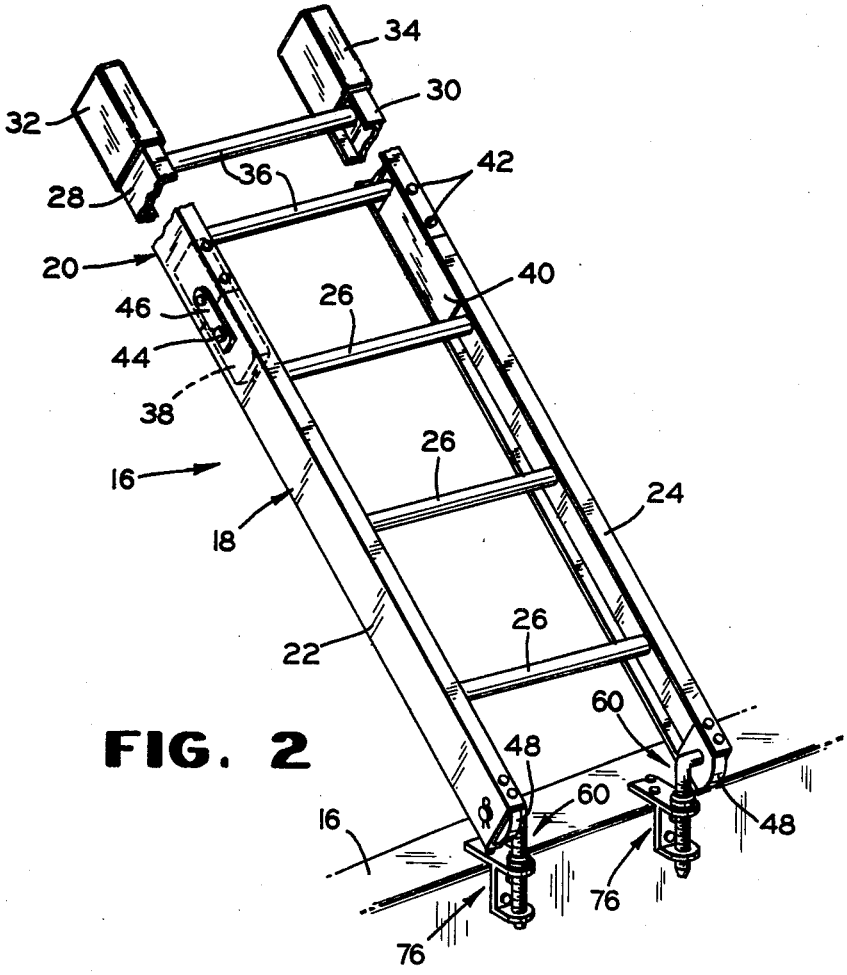
FIG. 2 is an enlarged, fragmentary view in perspective of the boat ladder of FIG. 1.

Referring to FIG. 2, the ladder 14 usually includes two or more ladder sections 18 and 20. The lower ladder section 18 is preferably three feet long, and, as shown, has fiber glass rails 22 and 24 of generally C-shaped configuration in transverse cross-section. The ladder section 18 has three metal rungs 26 extending between the rails 22 and 24, the rungs being one foot apart with the lower one being spaced six inches from the lower ends of the rails and the upper one spaced six inches from the upper ends of the rails. The rungs 26 preferably are round, or at least symmetrical about a vertical center line in transverse section, so that the ladder can be used with equal facility on either side of the boat, as will be discussed more fully subsequently.

The upper section 20 also includes rails 28 and 30 which have upper plastic end caps 32 and 34 to enable one to mount and leave the ladder more comfortably. This section also has rungs 36 which are round or at least symmetrical and are spaced the same as the rungs 26 of the lower section 18, being one foot apart and six inches from the ends of the three-foot section.

Connecting bars 38 and 40 are affixed in the channel-shaped rails 28 and 30 by suitable fasteners 42 and extend downwardly from the lower ends of the rails 28 and 30. These lower ends can extend into the upper ends of the rails 22 and 24 when the sections 18 and 20 are assembled. When the sections are assembled, they can be mechanically held together by suitable catches. As shown, the rails 22 and 24 of the lower section 18 have pins 44 which are engaged by notches of hook plates 46 pivotally mounted on the lower ends of the rails 28 and 30. Of course, various other types of catches can be used for this purpose.

When an intermediate ladder section is used, it can be two, three, or four feet in length. The top section is connected to the intermediate one by the bars 38 and 40 and the intermediate one connected to the lower or base section by similar bars.

Figure 3:
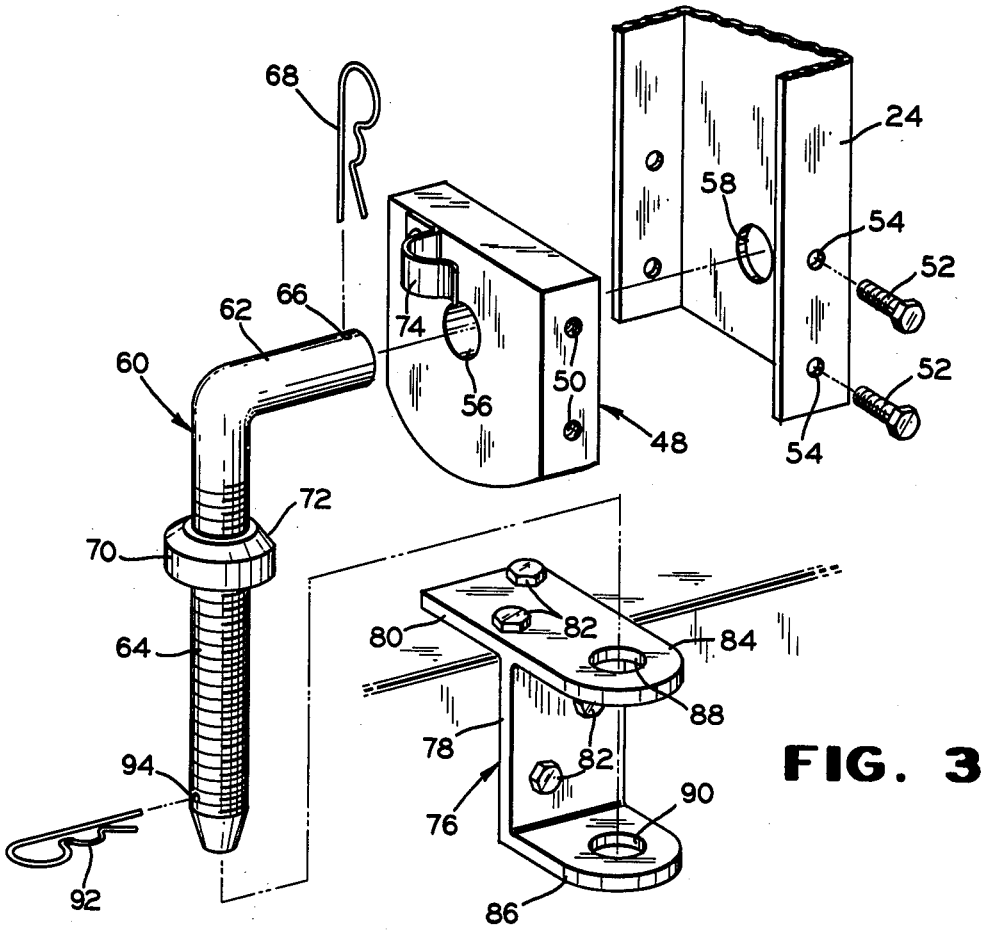
FIG. 3 is a further enlarged, fragmentary view of a portion of a ladder rail and mounting components for mounting the ladder on the gunwhale of the boat.

For mounting the ladder 14 on the gunwhale 16 of the boat 10, the lower end of each of the rails 22 and 24 has a pivot block 48 attached thereto. For this purpose, the block 48 has threaded openings 50 (FIG. 3) therein which receive screws 52 extending through openings 54 in the rails 22 and 24. The pivot block 48 is designed to fit snugly within the channel of the rail, having a width substantially equal to that of the rail and a thickness substantially equal to the width of the flanges of the rail. The pivot block also has a central opening 56 therein which is aligned with a similar opening 58 in the rail.

The mounting components for the ladder also include threaded mounting members or pins 60. Each of these has a transversely-extending pivot shank 62 and a threaded vertical shank 64. The pivot shank 62 extends through the opening 56 in the block 48 and through the opening 58 in the ladder rail. In this instance, the shank 62 has a transverse passage 66 therein which is located beyond the outer surface of the rail 24 when the mounting pin 60 is assembled with the block 48. A retaining clip 68 is then inserted through the hole 66 to retain the mounting pin 60 with the ladder. Of course, various types of retaining clips can be employed. Further, if the ladder and mounting components are sold as a complete assembly, the mounting pin can be permanently assembled with the ladder rail through various retaining washers or by having the end of the shank 62 flared outwardly.

Figure 4:
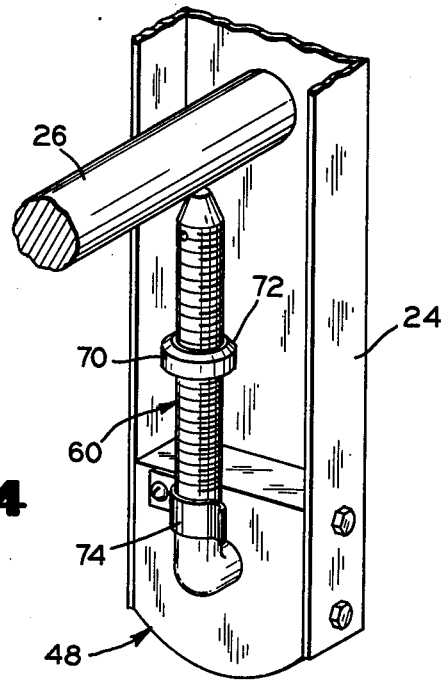
FIG. 4 is a fragmentary view in perspective of ladder mounting components with a mounting pin in an out-of-the-way position.

The threaded, adjusting shank 64 of the mounting pin preferably has the thread running a substantial portion of the length and has a stop collar 70 mounted thereon for the adjustment along the length of the thread. A portion 72 of the stop collar can be cut away so that the collar will more easily clear the rail of the ladder when swung to an out-of-the-way position, as shown in FIG. 4. In that position, the mounting pin 60 can be held by a spring clip 74 affixed to the pivot block 48. The ladder can then be used for other purposes and the pin will be out of the way when the ladder is stored so as not to take up extra space and also possibly cause injuries.

Rather than using the threaded shank and collar, the collar can be secured by means of a setscrew or pin. Also, several spacers could be used, if desired.

For mounting the ladder assembly on the gunwhale, two brackets 76 are employed which can be of various shapes and even mounted in the gunwhale, if desired. As shown, each of the brackets 76 includes a generally vertical plate 78 and an upper generally horizontally-extending flange 80. These are designed to fit on the gunwhales of most boats with the two plates having staggered openings for receiving fastening screws 82. The mounting bracket 76 also has an upper ear 84 and a lower ear 86 with aligned, generally horizontal openings 88 and 90 therein. To mount the ladder assembly on the boat, the mounting pins 60 are inserted downwardly through the openings 88 and 90. Since the gunwhales of the boats often slope downwardly toward the stern in varying degrees, the stop collars 78 are turned relative to the threaded shanks 64 to place the ladder 14 in an upright position. Hence, the ladder assembly can be used with a wide variety of boats.

If desired, the two brackets can be mounted on a common mounting plate. Also, the mounting plate can be affixed in a level position to the gunwhale inner wall of the boat.

When the mounting pin 60 is assembled with the bracket 76, a suitable retaining clip 92 can be inserted through a transverse hole 94 in the lower end of the threaded shank 64, below the lower ear 86, to assure that the ladder assembly will not become disassembled from the brackets. Again, a wide variety of retaining clips can be used for this purpose with the clip shown being only for illustrative purposes.

Referring to FIG. 1, a second pair of the brackets 76 can be located on the opposite gunwhale of the boat, in the same position lengthwise of the boat as the first pair. With this arrangement, the boat owner can simply disconnect the ladder from the one pair of brackets and move the ladder directly over to the other pair when it is desired to board or disembark the boat from the opposite side. By keeping the ladder in the same position, no adjustment of the mounting pins 60 is required. With the rungs 26 of the ladder being round, or at least symmetrical, the ladder can be climbed from either side of the boat with equal facility.

Various modifications of the above described embodiment of the invention will be apparent to those skilled in the art, and it is to be understood that such modifications can be made without departing from the scope of the invention, if they are within the spirit and the tenor of the accompanying claims.

I claim:

1. In combination, a boat having a gunwhale, a pair of spaced brackets mounted on the gunwhale and having openings therein, a ladder section comprising two rails and at least one rung extending therebetween, the bottom ends of said rails having elongate mounting members pivotally received therein for pivotal movement about axes perpendicular to the ladder rails, said elongate members being received in said openings, one of said elongate members and said brackets having means to maintain the ladder upright even if the gunwhale slopes.

2. The combination according to claim 1 characterized by at least one additional ladder section, and means for connecting the lower ends of said additional ladder section to the upper ends of said rails.

3. The combination according to claim 1 characterized by said last-named means comprising said elongate members having threaded shanks received in said bracket openings, and adjustable stop collars threaded on said shanks.

4. The combination according to claim 1 wherein said last-named means comprises said elongate members having adjustable stops thereon engagable with said brackets.

5. The combination according to claim 1 characterized by pivot blocks affixed to the bottom ends of said rails and having central openings therein, said elongate members having transverse pivot shanks pivotally received in said central openings.

6. The combination according to claim 5 characterized by said pivot blocks having clips for engaging said elongate members when pivotally moved to positions along said rails.

7. The combination according to claim 1 characterized by said rails of said ladder section having C-shaped transverse cross sections and said rung of said ladder section being round in transverse cross section.

8. A mounting kit for mounting a boarding and disembarking ladder on the gunwhale of a boat, said kit comprising at least two mounting brackets having means for affixing the brackets to the gunwhale of the boat and having openings therein, two mounting pins having pivot shanks and adjusting shanks, stop collars mounted on said adjusting shanks, and two pivot blocks for pivotally mounting said mounting pins on the lower ends of ladder rails.

9. A mounting kit according to claim 8 characterized by said pivot blocks having retaining clips thereon for holding said mounting pins in out-of-the-way positions.

10. A mounting pin according to claim 8 characterized by said adjusting shanks being threaded, and said stop collars being threaded on said adjusting shanks.

* * * * *